US006021798A

United States Patent [19]

Martin

[11] Patent Number: 6,021,798

[45] Date of Patent: Feb. 8, 2000

[54] APPARATUS FOR PREVENTING FREEZING OF INTERIOR WATER PIPES

[76] Inventor: Steven E. Martin, 3088 Placer Rd., Sunny Valley, Oreg. 97497

[21] Appl. No.: 09/122,570

[22] Filed: Jul. 24, 1998

[51] Int. Cl.[7] ..... E03B 7/10

[52] U.S. Cl. ..... 137/62; 137/59

[58] Field of Search ..... 137/59, 61, 62

[56] References Cited

U.S. PATENT DOCUMENTS 4,360,036 11/1982 Shelton ..... 137/61

4,635,668 1/1987 Netter ..... 137/62

*Primary Examiner*—John Fox

*Attorney, Agent, or Firm*—Robert E. Howard

[57] ABSTRACT

An apparatus for preventing freezing of interior water pipes. A thermal switch is attached to a hot and/or cold water supply pipe in a remote location that is prone to freezing in cold weather. The thermal switch electrically communicates with a power source and with a solenoid-actuated valve. The solenoid-actuated valve is located in a conduit communicating the outlet of the water pipe adjacent a water usage station with the water outlet of a fixture located at the water usage station. This conduit is separate from the existing supply line communicating the outlet of the water pipe with the fixture and does not, therefore, interfere with the normal operation of the fixture.

4 Claims, 3 Drawing Sheets

APPARATUS FOR PREVENTING FREEZING OF INTERIOR WATER PIPES

BACKGROUND OF THE INVENTION

This invention relates to an apparatus for preventing freezing of interior hot and/or cold water pipes and fixtures during cold weather.

It is well known that one way of preventing a water pipe from freezing during cold weather is to manually open an outlet valve in the pipe and allow water to slowly flow (trickle) therefrom. However, this technique requires the input of a human being who may or may not be present when flow should be instituted or terminated.

A number of devices have been proposed over the years for preventing water pipes of buildings from freezing in cold weather by automatically causing water to drain or trickle therefrom in response to a drop in temperature below the freezing point.

U.S. Pat. No. 299,392 discloses one such device. Metal rods C and F that expand and contract with heat and cold open and close a valve B connected to a waste water line D. The waste water line D is connected to a service water pipe A. This device relies upon outside temperatures to actuate the bleed valve since rod C is illustrated as being located outside the building.

U.S. Pat. No. 1,226,696 discloses a device which cuts off the supply of water to the supply pipe of a house and drains it when the temperature falls below freezing.

U.S. Pat. No. 4,286,613 discloses a particular type of temperature sensitive valve for bleeding water from a plumbing system when the temperature drops below freezing.

U.S. Pat. Nos. 4,469,118 and 4,657,038 disclose apparatus for slowing bleeding water from an outdoor water line when the outdoor temperature drops below freezing.

Many of these devices, when in the bleeding or trickling mode, prevent normal water usage of the building plumbing. Furthermore, all of these devices respond to ambient inside or outside air temperature which does not normally represent the temperature of the water in the water lines.

The objects of the present invention are: (1) to provide an automatic water trickling system to prevent freezing of interior water lines which does not interfere with the normal usage of water from those lines; (2) to provide such a system that is closely responsive to water temperatures in such water lines at freeze prone remote locations; and (3) to prevent water wastage. These and other objects will become apparent from the description of the preferred embodiments of this invention described below.

SUMMARY OF THE INVENTION

The present invention is an apparatus to automatically prevent the freezing of interior water pipes by causing a trickle of water to flow from an existing water supply fixture, such as a faucet, shower-head, spray, etc., and into its associated drain when the temperature of a remote portion of the water pipe supplying such fixture drops below freezing.

The apparatus comprises a temperature responsive thermal switch attached to an interior water supply pipe at a location that is prone to freezing, an existing interior water outlet fixture located at a water usage station, a conduit communicating the water supply pipe with the water outlet fixture through a solenoid-actuated valve, and electrical circuitry communicating the thermal sensor, the solenoid-actuated valve and a suitable power source.

When the temperature of the water in the pipe adjacent the location of the thermal sensor drops below freezing, the sensor is actuated and completes an electrical circuit from a power source to a solenoid-actuated valve to thereby cause it to open and allow water to trickle from the water supply pipe through an existing water outlet fixture and down its adjacent (and pre-existing) drain. When the temperature rises above freezing, the sensor is de-actuated to interrupt the flow of electricity from the power source to the solenoid-actuated valve, and thereby close the valve and stop the flow of water therethrough.

Thus, the present invention utilizes existing plumbing and water outlet fixtures and does not require extensive modification thereto. Also the apparatus does not interfere with normal usage of such water outlet fixtures even when the apparatus is in the freeze protecting (water trickling) mode.

Water is not wasted since the apparatus automatically terminates the flow of water when the temperature in the location of the sensor rises above freezing.

In addition, since existing interior drains are used there is no spillage of water on interior or exterior surfaces which could freeze and cause dangerous conditions.

DETAILED DESCRIPTION OF THE PREFERRED EMBODIMENTS

Figure 1:
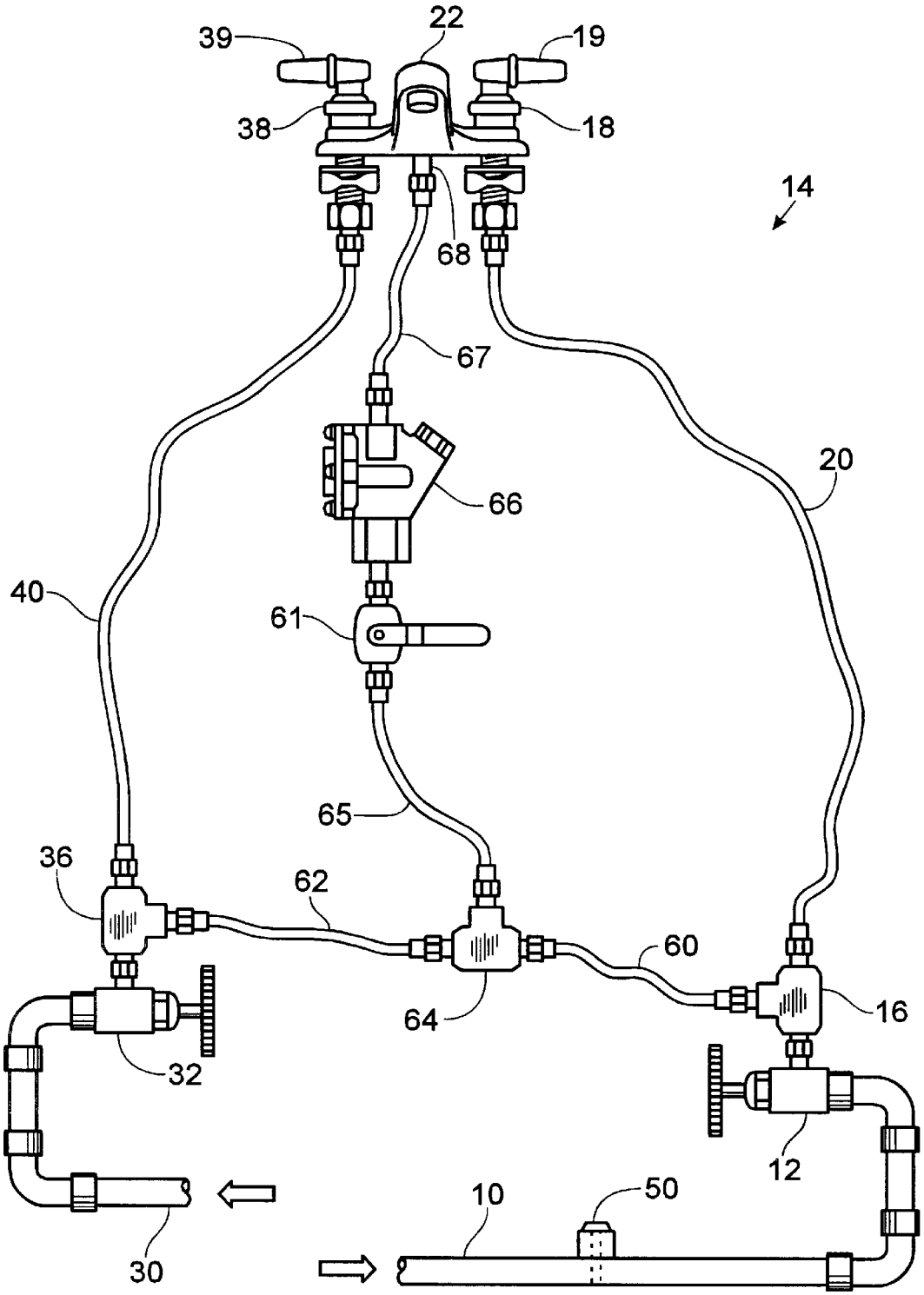
FIG. 1 is a front view of the invention configured to protect both hot and cold water pipes from freezing.

In FIG. 1, an interior cold water pipe 10 transmits cold water, flowing in the direction of the arrow, to a cold water shut-off valve 12 located at a water dispensing station 14. By "water dispensing station" is meant the aggregation of a water dispensing fixture or fixtures and adjacent drain, such as a lavatory, kitchen sink, laundry tub, shower, bathtub, etc., and associated plumbing for connecting the fixture to hot and cold water supply pipes.

When shut-off valve 12 is in the open position, communication is established between cold water supply pipe 10 and a cold water tap valve 18 via rigid or flexible conduit 20. Thus, when tap valve 18 is opened by manually turning tap handle 19 to the open position, cold water flows to and out of faucet 22 in a manner well known in the art. The faucet illustrated in FIG. 1 is a typical lavatory type faucet.

Similarly, an interior hot water pipe 30 supplies hot water to a hot water shut-off valve 32 located at water dispensing station 14. When shut-off valve 32 is in the open position, communication is established between hot water supply pipe 30 and a hot water tap valve 38 via rigid or flexible conduit 40. Thus, when tap valve 38 is opened by manually turning tap handle 39 to the open position, hot water flows to and out of faucet 22 in a manner well known in the art.

Thermal switch 50 is attached to a freeze prone portion of cold water pipe 10. Such freeze prone portion of pipe 10 would typically be located in unheated areas of the building, such as the basement, crawl space, attic, exterior wall, etc. A suitable thermal switch is one marketed by Motor & Armature, Inc. of Hauppaute, N.Y. under the name "Klixon".

In order to provide for automatic trickling of cold and/hot water from water supply lines 10 and 30, respectively, rigid or flexible conduits 60 and 62 are connected at one of their ends to tees 16 and 36, respectively, and at their other ends to tee 64 having a built in check valve. A suitable tee/check valve is one marketed by Speakman Co. of Wilmington, Del.

Rigid or flexible conduit 65 is connected at one end to the outlet port of tee/check valve 64 and at its other end to the inlet port of solenoid-actuated valve 66. A suitable solenoid-actuated valve is one marketed by Sloan Valve Co. of Franklin Park, Ill.

It is desirable to locate an adjustable valve, such as ball valve 61, upstream (as illustrated) or downstream of solenoid-actuated valve 66 to provide a means for shutting off water thereto for repairs, etc., and to provide a means for adjusting the volume of the flow of water to solenoid-actuated valve 66 to a freeze preventing level. A suitable volume control ball valve is one manufactured by B & K Industries, Inc. of Elk Grove Village, Ill.

Rigid or flexible conduit 67 is connected at one end to the outlet port of solenoid-actuated valve 66 and at its other end to a nipple 68 seated in a drilled and tapped hole located in faucet 22, as shown.

Figure 3:
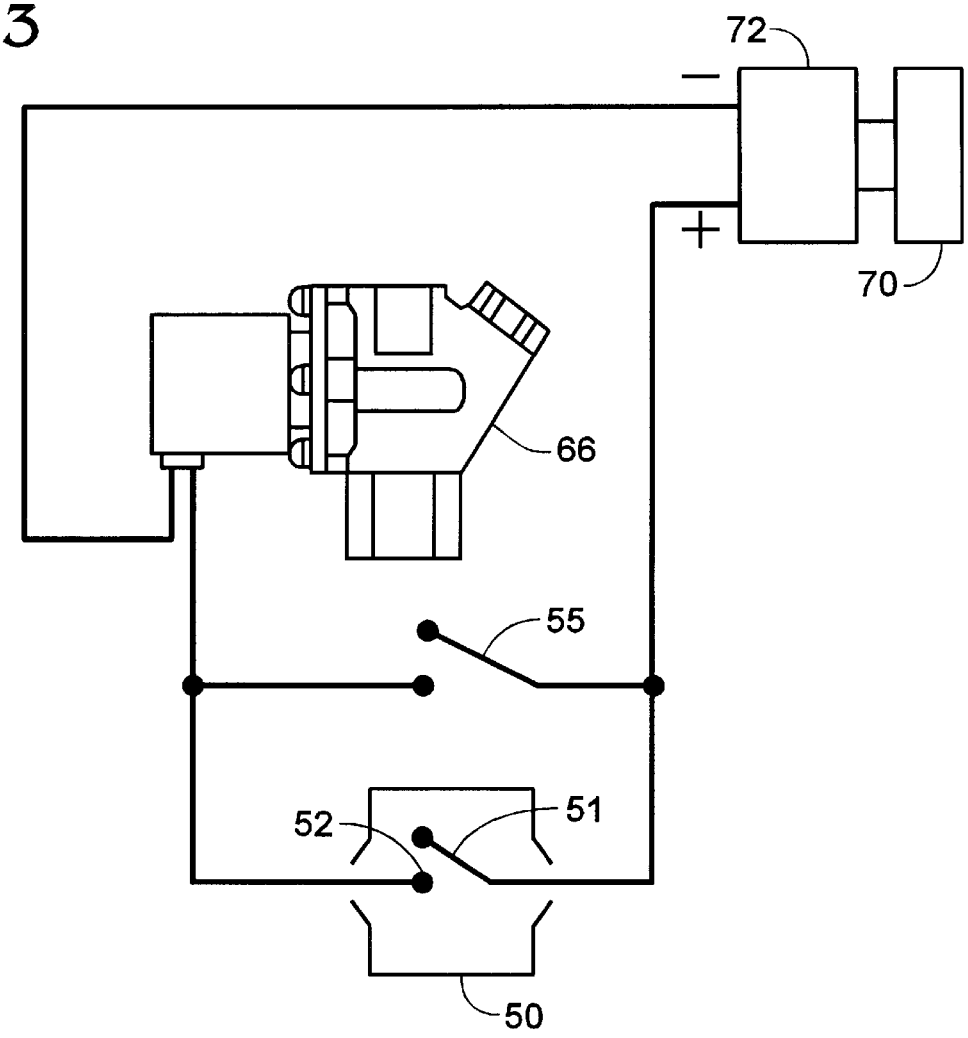
FIG. 3 is a schematic view of an electrical circuit used in operating the invention.

FIG. 3 illustrates a suitable electrical circuit connecting thermal switch 50 to solenoid-actuated valve 66 and a power source 70. As previously stated, thermal switch 50 is attached to cold water pipe 10, as illustrated in FIG. 1.

As seen by reference to FIG. 3, thermal switch 50 has a contact arm 51 which is normally retained in the retracted position illustrated. With contact arm 51 in such retracted positions, the circuit connecting solenoid-actuated valve 66 and power source 70 is open (interrupted) and current cannot flow therebetween. When the circuit is thus open, solenoid-actuated valve 66 will remain closed and prevent water from passing from conduit 65 to faucet 22 via conduit 67.

If thermal switch 50 is actuated by the temperature in water pipe 10 dropping to the freezing point of water, the contact arm 51 will close and come into contact its associated contact pin 52, and close (complete) the circuit between the power source 70 and solenoid-actuated valve 66. With the circuit thus closed, solenoid-actuated valve 66 will open and allow water to pass through from conduit 65 to faucet 22 via conduit 67.

A single pole, single throw toggle type switch 55 is located in the circuit illustrated in FIG. 3 to allow testing of the water flow rate through solenoid-actuated valve 66. When toggle switch 55 is closed, solenoid-actuated valve 66 is actuated to the frost protection mode i.e., opened, and, while it is open, ball valve 61 is adjusted to provide the desired freeze prevention water flow rate through valve 66, conduit 67 and faucet 22.

As can be seen, the device of the present invention is automatic and in either mode of operation does not interfere with the normal use of faucet 22.

For safer operation a transformer 72 (shown in FIG. 3) may be employed to step the voltage down to a safer level, such as 24 volts AC. In such a case, solenoid-actuated valve 66 and thermal switches 50 and 53 would be selected to operate with the selected voltage.

Alternatively, the power source may be batteries, or batteries may be used to provide a back-up power source in the event of a power outage.

The operation of the invention illustrated in FIG. 1 will now be described.

When the temperature of cold water pipe 10 reaches the freezing temperature of water, contact arm 51 of thermal switch 50 closes from the open position shown in FIG. 3 into contact with contact pin 52, thereby closing the electrical circuit between power source 70 and solenoid-actuated valve 66. Upon this occurrence, solenoid-actuated valve 66 is caused to open (in a manner well known in the art) and cold and hot water from supply pipes 10 and 30, respectively, then flows from conduit 65 through faucet 22 via conduit 67. The output of water passing through solenoid-actuated valve 66 has been previously adjusted by means of ball valve 61 to provide for a suitable trickle of water, such trickle having sufficient volume to prevent cold water pipe 10 and hot water pipe 30 from freezing.

When the temperature of cold water pipe 10 rises above the freezing point of water, the reverse action takes place. That is, upon such a rise in temperature contact arm 51 of thermal switch 50 opens to interrupt the electrical circuit conveying electricity between power source 70 and solenoid-actuate valve 66, and thereby cause valve 66 to close in a manner well known in the art.

Figure 2:
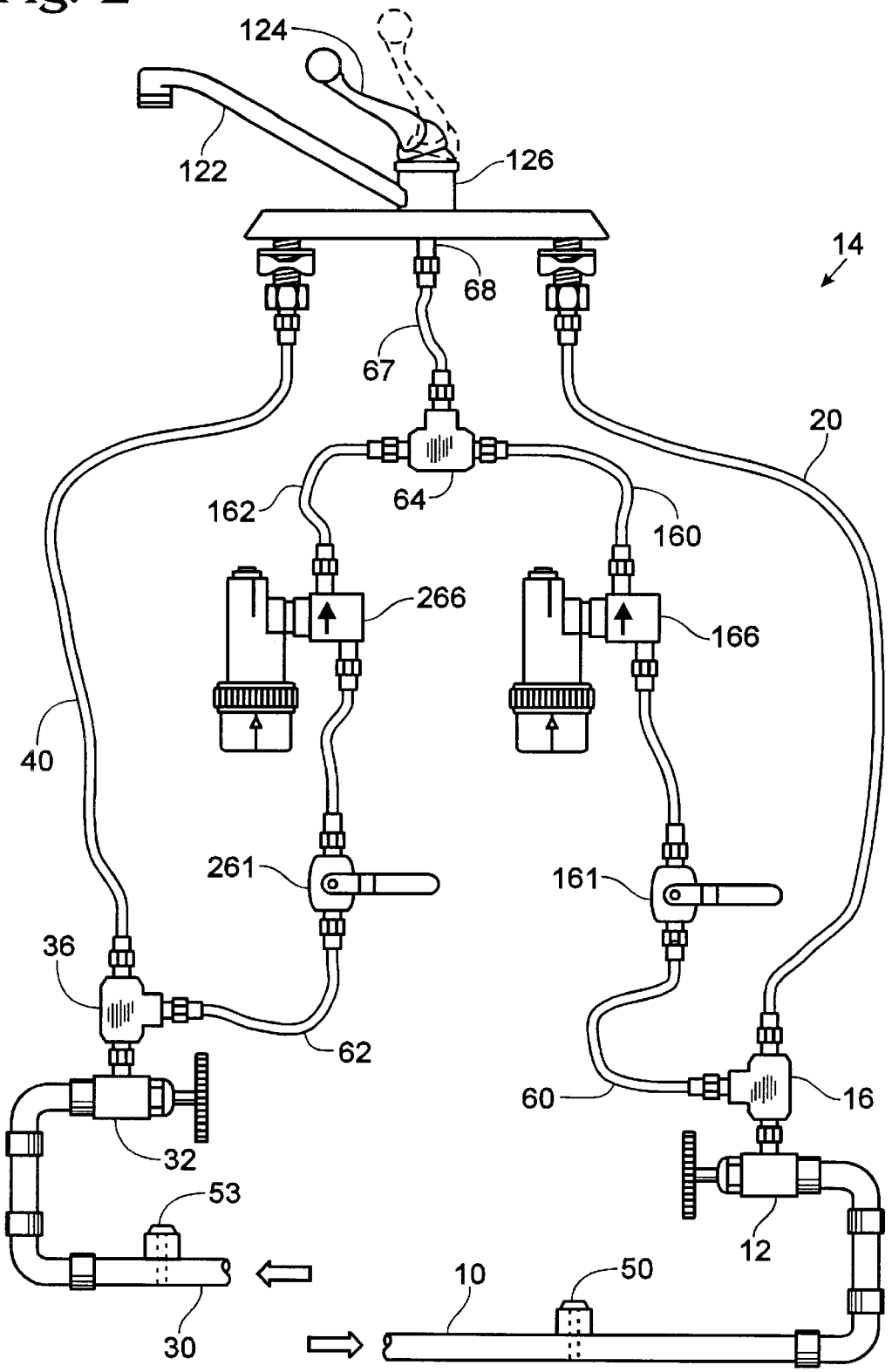
FIG. 2 is a front view of an alternative configuration of the invention with separate solenoid-actuated switches controlling trickling from the hot and/or cold water lines.

FIG. 2 shows an alternative plumbing configuration to that illustrated in FIG. 1, the primary difference being that the hot and cold water pipes each have their own thermal switches that are each in communication with their own solenoid-actuated valve. Components that are the same as those illustrated in FIG. 1 have the same reference numbers.

In the configuration of FIG. 2, cold water conduit 60 communicates with the inlet of solenoid-actuated valve 166 via adjustable ball val;ve 161 and hot water conduit 62 communicates with the inlet of solenoid-actuated valve 266 via adjustable ball valve 261.

One end of cold water conduit 160 communicates with the outlet of solenoid-actuated valve 166 and the other end communicates with an inlet of tee/check valve 64. Similarly, one end of hot water conduit 162 communicates with the outlet of solenoid-actuated valve 266 and the other end communicates with an inlet of tee/check valve 64. The outlet of tee/check valve 64 communicates with a nipple 68 inserted into a drilled and tapped hole in faucet 22 via rigid or flexible conduit 67.

In FIG. 2 the faucet 122 is illustrated as being a kitchen type faucet having a swiveling manually operated handle 124 and associated valving mechanism located in housing 126.

Ball valves 161 and 261 are inserted into conduits 60 and 62 between tees 16 and 36 and solenoid-actuated valves 166 and 266, respectively, to allow water to said solenoid-actuated valves to be shut off for repairs, etc., and to control the volume of water flowing through solenoid-actuated valves 166 and 266, respectively.

Thermal switch 53 associated with hot water pipe 30 is connected to power source 70 and its associated solenoid-actuated valve 266 by the same type of circuitry illustrated in FIG. 3 relative to thermal switch 50.

FIGS. 1 and 2 have illustrated the invention relative to utilizing an existing sink faucet to protect water pipes against freezing. It is clear that the invention may also be attached to fixtures at other types of pre-existing water dispensing stations located in a building, such as a shower head, the mixing valve of a shower head or tub faucet, kitchen sink hose and spray device, bath or laundry tub, etc.

The invention has been described relative to preferred embodiments thereof; however, it is to be understood that modifications may be made thereto which will fall within the scope of the invention as described in the claims below.

The invention claimed is:

1. An apparatus for preventing freezing of at least one of a hot or cold water supply pipe located inside a building, which said water supply pipe extends from a remote water inlet end to a water outlet end located adjacent a water usage station, said water usage station having a water supply fixture which includes a water outlet and at least one manually operated valve located upstream of said water outlet, at least one freeze prone portion of said water supply pipe being located in a portion of said building where the ambient temperature adjacent said water supply pipe is subject to dropping below the freezing point of water during cold weather, comprising:

a thermal switch attached to said water supply pipe in said freeze prone portion;

a first conduit communicating the outlet end of said water supply line to the inlet of a solenoid-actuated valve;

a second conduit communicating the outlet of said solenoid-actuated valve with said water outlet of said fixture downstream of said manually operated valve; and electrical circuitry operably connecting said thermal switch and said solenoid-actuated valve to an electric power source, said thermal switch being configured to close the circuit between said power source and said solenoid-actuated valve at a temperature up to about the freezing point of water and to open the circuit at a temperature above the freezing point of water, said solenoid-actuated valve being in a closed position when said circuit is open and open when said circuit is closed.

2. The apparatus of claim 1 in which said thermal switch is attached to said cold water supply pipe.

3. The apparatus of claim 1 wherein an adjustable valve is located upstream or downstream of said solenoid-actuated valve to permit adjustment of the volume of water flowing through said solenoid-actuated valve.

4. The apparatus of claim 1 in which said thermal switch is attached to said cold water supply pipe, and wherein a second thermal switch is attached to said hot water supply pipe at a remote location and communicates with said water outlet of said fixture via a second solenoid-actuated valve, said second thermal switch and said second solenoid-actuated valve being operably connected to said power source.

* * * * *